US005443203A

United States Patent [19]

Sutherland

[11] Patent Number: 5,443,203

[45] Date of Patent: Aug. 22, 1995

[54] CARTON PANEL LOCK

[75] Inventor: Robert L. Sutherland, Kennesaw, Ga.

[73] Assignee: Riverwood International Corporation, Atlanta, Ga.

[21] Appl. No.: 316,751

[22] Filed: Oct. 3, 1994

[51] Int. Cl.[6] ..... B65D 5/42

[52] U.S. Cl. ..... 229/198.2; 206/427; 229/103.2

[58] Field of Search ..... 229/103.2, 198.2; 206/140, 427

[56] References Cited

U.S. PATENT DOCUMENTS

| | | | |
|---|---|---|---|
| 3,384,291 | 5/1968 | Graser | 229/40 |
| 3,432,029 | 3/1969 | Brown | 206/140 |
| 3,478,951 | 11/1969 | Graser | 206/140 |
| 3,589,593 | 6/1971 | Weiss | 206/140 |
| 3,945,560 | 3/1976 | Harrelson et al. | 229/103.2 |
| 4,049,189 | 9/1977 | Wood | 206/427 |
| 4,679,725 | 7/1987 | Wilson | 229/103.2 |
| 4,708,284 | 11/1987 | Sutherland et al. | 229/198.2 |
| 4,773,540 | 9/1988 | Schuster | 206/140 |
| 5,004,147 | 4/1991 | Bienalne | 229/103.2 |
| 5,328,080 | 7/1994 | Holley, Jr. | 206/140 |
| 5,364,022 | 11/1994 | Ganz | 229/198.2 |

*Primary Examiner*—Gary E. Elkins

[57] ABSTRACT

A wrap-around carrier having improved secondary locking means. A secondary locking tab contains a retaining opening, and one edge of a secondary locking opening includes a retaining tab which fits into the retaining opening to prevent withdrawal of the locking tab. A retaining flap engaging the secondary locking tab prevents the locking tab from moving out of engagement with the retaining tab.

14 Claims, 4 Drawing Sheets

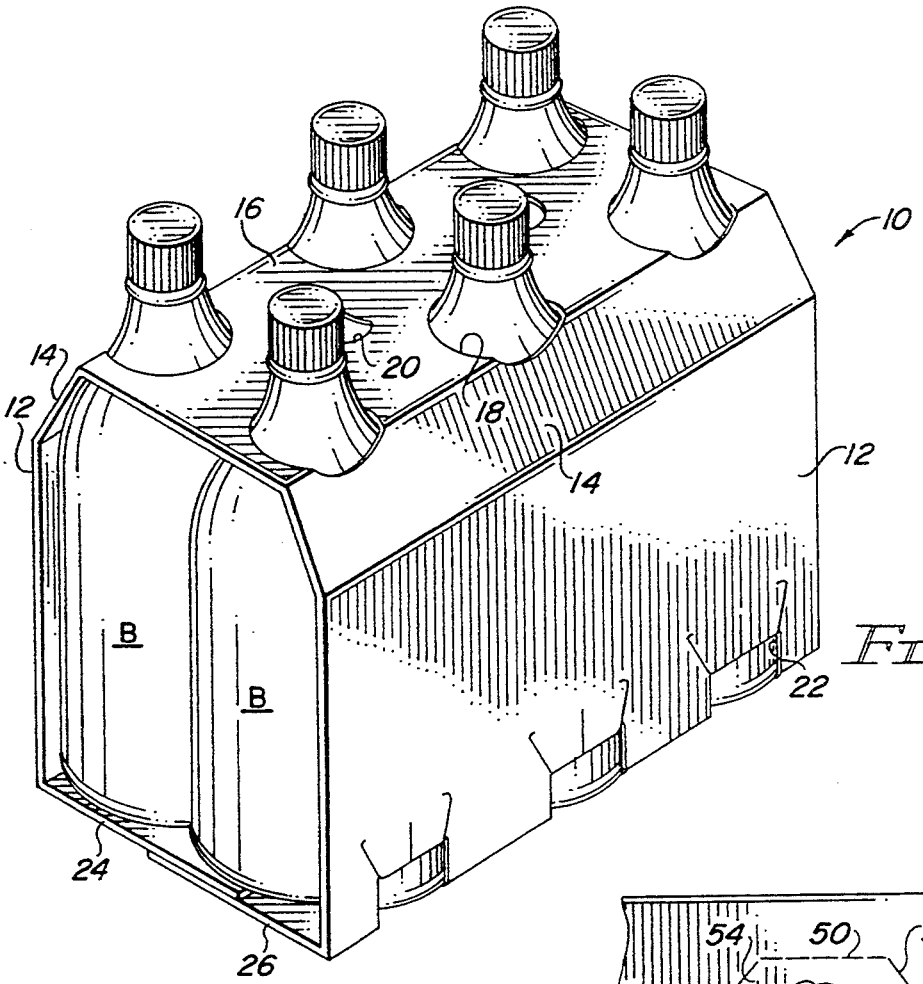
FIG. 1
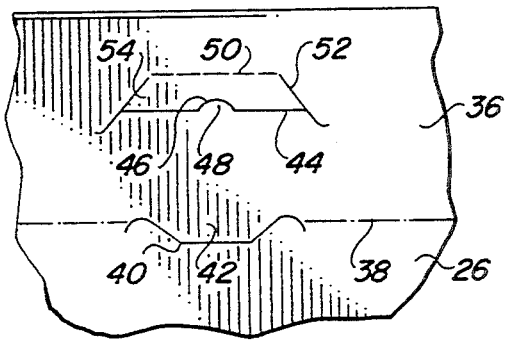
FIG. 3
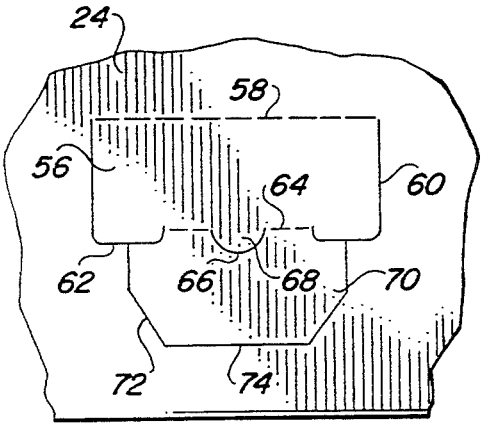
FIG. 4
FIG. 13
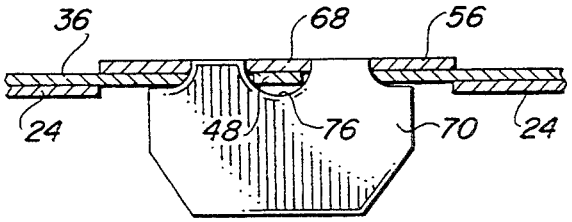

CARTON PANEL LOCK

FIELD OF THE INVENTION

This invention relates to mechanical locks for holding overlapping flaps of a carrier or other carton in place. More particularly, it relates to a mechanical lock having means for preventing withdrawal of a male locking tab element.

BACKGROUND OF THE INVENTION

When fabricating a carton from a paperboard blank opposite ends of the blank are conventionally attached to each other by glue or by a mechanical lock to form a panel of the carton. In the case of a wrap-around carrier flaps at the ends of the blank typically are overlapped and connected by mechanical locks to form the bottom panel of the carrier. Since the bottom panel cannot be permitted to fail, it is essential that the locking system be capable of resisting forces caused by the weight of the packaged articles and by the stresses of shipping and handling which tend to pull the lock apart.

One approach to this problem utilizes primary and secondary locks. The primary locks connect the flaps together, while the secondary locks function to hold the flaps in place in order to prevent the primary locks from separating. Since it is essential to have strong secondary locks a number of systems employ rather large secondary male locking tabs, the fastening procedure of which typically requires the tabs to be located at the ends of the blank, extending out beyond the end edges of the blank. This is undesirable because the end location of the tabs does not permit the most economical blank layout during manufacture of the blanks.

Other designs provide secondary male locking tabs which are located entirely within the confines of a rectangular blank, but because of design constraints it is often difficult to adequately prevent withdrawal of the tabs from a carrier panel formed from overlapping flaps. A simple pull on the portion of the tabs extending into the interior of the carrier or the friction between the exterior portion of the tabs as the carriers slide across the packaging machine support surface can at times cause the tabs to separate and the bottom panel to fail.

It would be highly desirable to have a mechanical locking system which does not require the secondary male locking tabs to extend beyond the end edges of the blank but which effectively locks the tabs in place and resists withdrawal of the tabs.

BRIEF SUMMARY OF THE INVENTION

The invention provides a unique mechanical lock construction which prevents withdrawal of a locking tab after it has been inserted into a locking opening of an associated overlapping panel flap.

The overlapped or inner panel flap includes a locking tab connected to the flap by a fold line spaced from the end edge of the flap.. An intermediate fold line divides the locking tab into a base portion and an end portion which extends through a locking opening in the overlapping or outer panel flap. The end portion of the locking tab contains a retaining opening adjacent the intermediate fold line. One edge of the locking opening is comprised of an edge of a retaining flap and the opposite edge includes a retaining tab. The retaining tab extends through the retaining opening and the edge of the retaining flap contacts the end portion of the locking tab.

The retaining tab prevents withdrawal of the locking tab and the retaining flap prevents the locking tab from moving out of contact with the retaining tab. This is an especially effective locking arrangement when employed as the secondary lock of a wrap-around carrier, since it maintains the secondary lock in operative condition, thereby also maintaining the primary lock in operative condition. Further, it provides an exceptionally strong lock even though the secondary locking tabs do not extend beyond the edge of the blank.

The above and other aspects of the invention, as well as other benefits, will readily be apparent from the more detailed description of the preferred embodiment which follows.

BRIEF DESCRIPTION OF THE DRAWING

FIG. 1 is a pictorial view of a wrap-around bottle carrier which incorporates the tab locking features of the invention;

FIG. 3 is an enlarged plan view of the portion of FIG. 2 within the circle 3;

FIG. 4 is an enlarged plan view of the portion of FIG. 2 within the circle 4;

FIG. 13 is a longitudinal sectional view taken along line 13—13 of FIG. 11, which extends along the face of the inserted end portion of the secondary locking tab.

DETAILED DESCRIPTION OF THE PREFERRED EMBODIMENT

Figure 2:
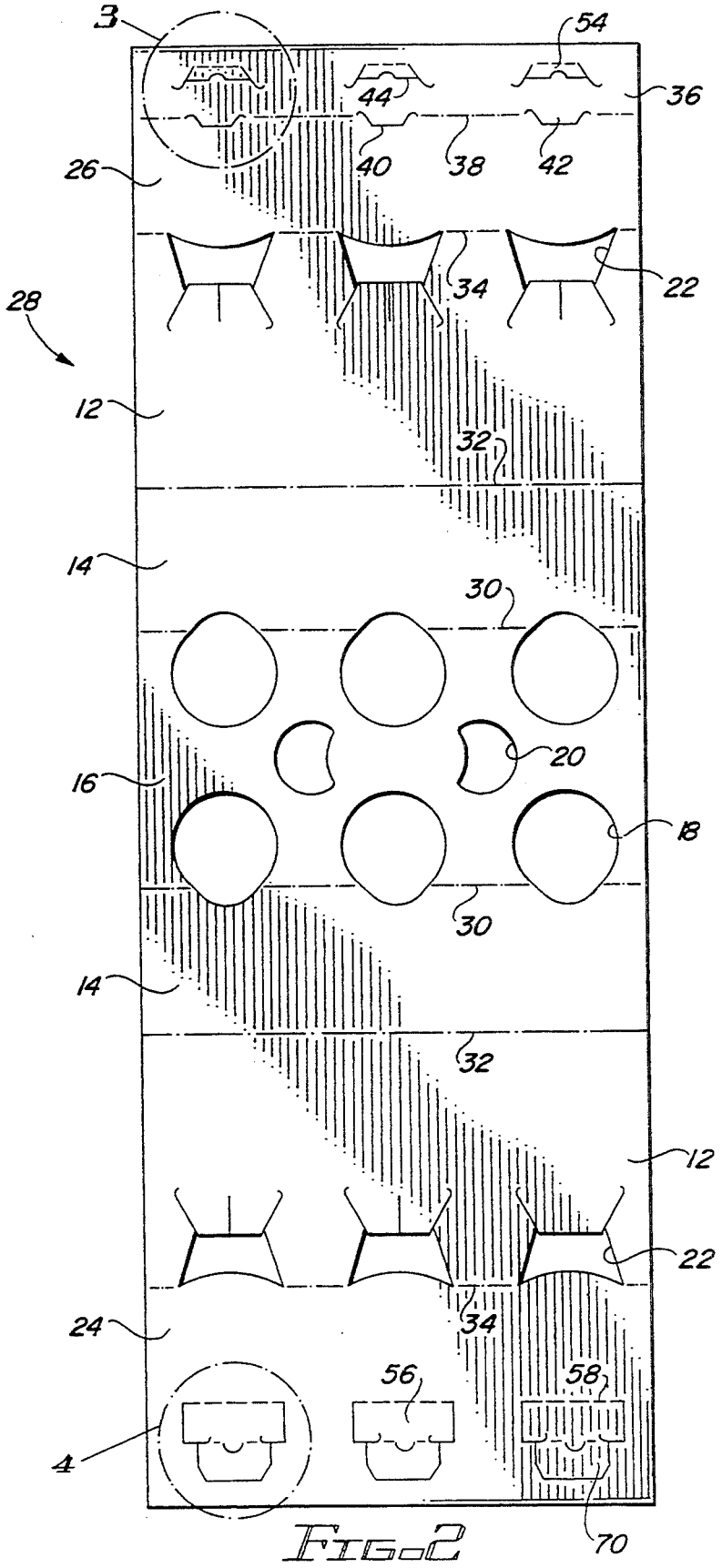
FIG. 2 is a plan view of a blank for forming the carrier of FIG. 1.

Referring to FIG. 1, a wrap-around carrier 10 is illustrated in connection with six beverage bottles B arranged in two rows of three each. The carrier is comprised of side panels 12 connected by sloped shoulder panels 14 to top panel 16. Bottle neck openings 18 permit the necks of the bottles to extend through the top panel and finger holes 20 provide handle openings for lifting the carrier. The carrier includes heel cutouts 22 adjacent the bottom panel, and the bottom panel is comprised of overlapping flaps 24 and 26.

A blank 28 for forming the carrier 10 is shown in FIG. 2, wherein similar reference numerals to those used in FIG. 1 denote similar elements. The blank is rectangular in shape and includes straight edges, which makes for an efficient layout of the blanks in a web from which the blanks are cut. The centrally located top panel section 16 is connected by fold lines 30 to the shoulder panel sections 14, and the shoulder panel sections in turn are connected by fold lines 32 to side panel sections 12. The bottle neck openings 18 are elongated into the shoulder panel sections to permit the packaged bottles to be located immediately adjacent the shoulder panels in the carrier, enabling the shoulder panels to closely follow the contour of the bottle shoulders. Fold lines 34, which are interrupted by the heel cutouts 22, connect the side panel sections to the bottom panel flaps.

As shown in FIGS. 2 and 3, the outer bottom panel flap 26 includes a locking panel section 36 connected to the main body of the flap 26 by a fold line 38. Interrupting the fold line 38 opposite each heel cutout 22 are spaced slits 40 which form primary locking tabs 42. Located in the locking panel section 36 opposite each primary locking tab are slits 44, each of which includes an outwardly extending arcuate portion 46 forming a small retainer tab 48. The slits 44 form secondary female locking openings which function in conjunction with the tabs 48 as explained in more detail below. Fold lines 50 are outwardly spaced from the slits 44, and the ends of the fold-lines 50 and the slits 44 are connected by transverse slits 52, which extend slightly beyond the slits 44. This arrangement forms retaining tabs or flaps 54 adjacent the slits 44.

As shown in FIGS. 2 and 4, the inner bottom panel flap 24 includes spaced secondary male locking tabs 56 located opposite each heel cutout 22 and connected to the inner bottom panel flap by fold lines 58. The main body of each secondary locking tab is formed by slits 60 extending outwardly from the ends of the fold line 58 and transversely toward each other at 62. The inner ends of the slit segments 62 are connected by fold line 64, which is interrupted by an arcuate slit 66 forming a small tab 68. The portion 70 of the secondary locking tab extending outwardly of the fold line 64 is further bounded by slits 72 the ends of which are connected by straight slit 74. The slit 74 forms a primary female locking edge which functions as explained below.

Figure 5:
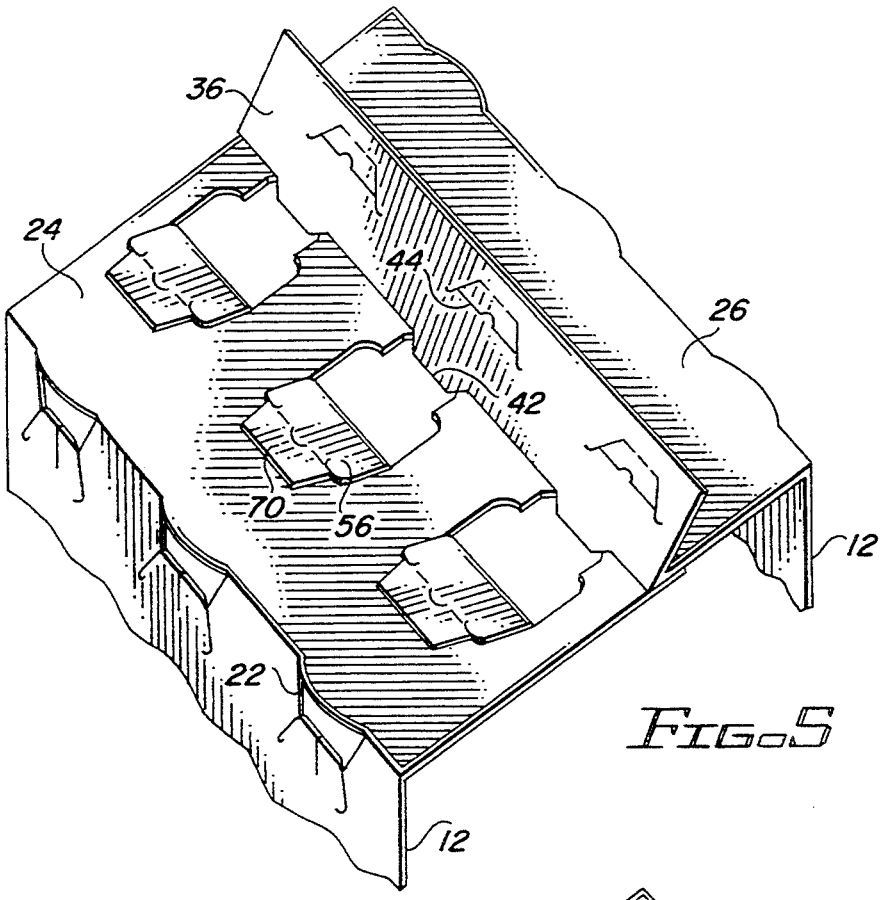
FIG. 5 is a pictorial view of the bottom of a carrier, with the bottles removed for the purpose of clarity, demonstrating the first phase of the formation of the bottom panel.
Figure 6:
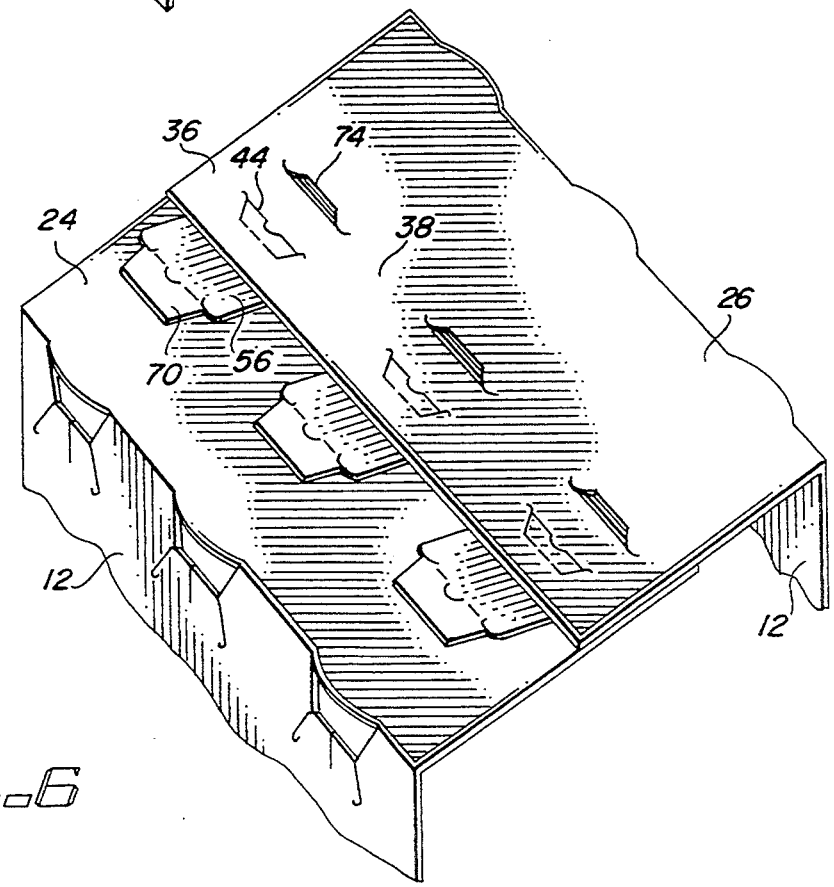
FIG. 6 is a pictorial view similar to that of FIG. 5 but showing the bottom panel flaps at a next intermediate stage of bottom panel formation.

A wrap-around package is formed by moving the top panel section of a blank so that the necks of a group of bottles to be packaged extend up through the bottle neck openings 18. The blank is pulled tightly about the bottles and the bottom panel flaps are overlapped. The locking panel section 36 and the secondary locking tabs 56 are then folded back as shown in FIG. 5, which omits the bottles for the purpose of clarity, after which the locking panel section is folded down into final position as shown in FIG. 6. During this procedure the primary locking tabs 42 engage the edge of the cutout formed by the slit 74 when the secondary locking tabs are folded back, and in their final position are located beneath the inner bottom panel flap 24.

Figure 7:
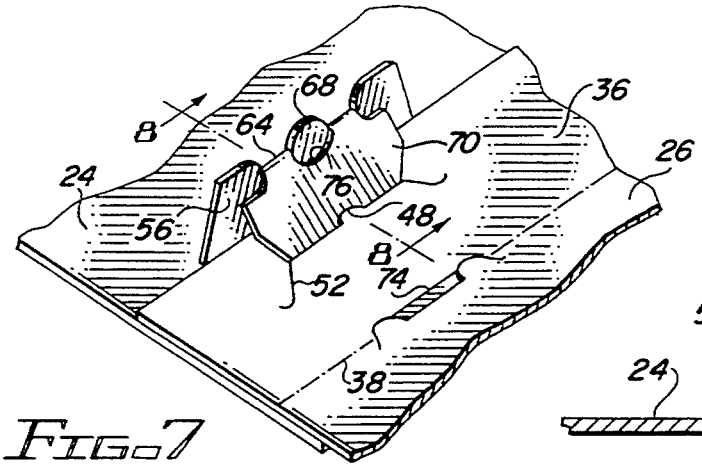
FIG. 7 is a partial pictorial view illustrating a secondary male locking tab in position to be inserted into a secondary female locking opening.
Figure 8:
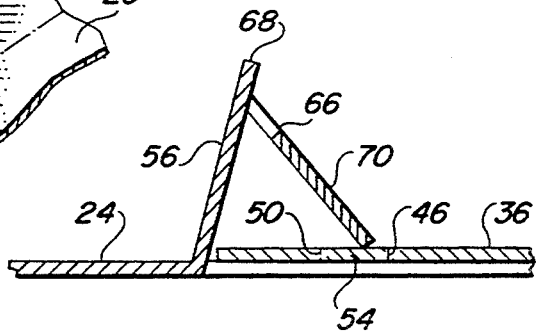
FIG. 8 is an enlarged transverse sectional view taken along line 8—8 of FIG. 7.
Figure 9:
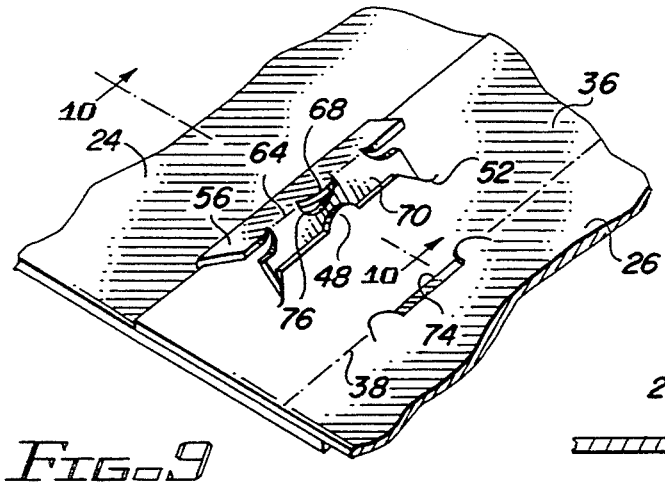
FIG. 9 is a partial pictorial view similar to that of FIG. 7, but illustrating the secondary male locking tab at a later intermediate position during formation of the bottom panel.
Figure 10:
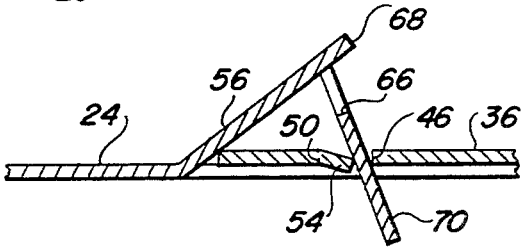
FIG. 10 is an enlarged transverse sectional view taken along line 10—10 of FIG. 9.

As shown in FIGS. 7 and 8, the secondary locking tabs are then pivoted forward about the fold lines 58 and their outer portion 70 is folded about the fold line 64 to position the ends of the locking tabs over the retaining flaps 54 of the secondary female locking openings adjacent the tabs 48. This causes the tabs 68 to separate from the slits 66 to form cutouts or retaining openings 76 of the same shape as the tabs 68. The secondary locking tabs are then pushed toward the interior of the carrier, causing the flaps 54 to slightly pivot about their fold lines 50 to permit the angular entry of the secondary locking tabs into the space created between the flaps 54 and the edge formed by the slit 44. The transverse slits 52 allow adjacent portions of the locking panel segment 36 to yield slightly to permit continued downward passage of the secondary locking tabs. The relationship of the various secondary locking elements to each other during this intermediate phase of the locking process is illustrated in FIGS. 9 and 10.

Figure 11:
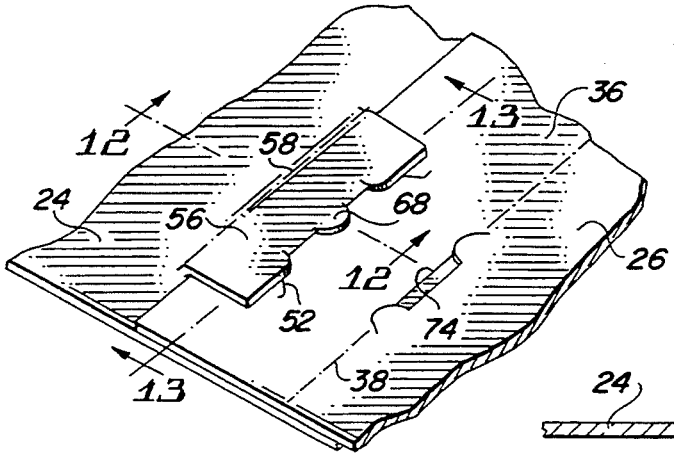
FIG. 11 is a partial pictorial view similar to that of FIG. 7, but illustrating the secondary male locking tab in its fully inserted position.
Figure 12:
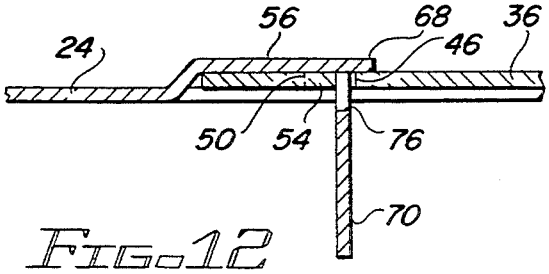
FIG. 12 is an enlarged transverse sectional view taken along line 12—12 of FIG. 11.

Continued movement of the secondary locking tabs results in the tabs being fully inserted into the secondary locking openings as shown in FIGS. 11 and 12. During movement of the outer portions 70 of the secondary locking tabs through the secondary locking openings, the angle between the outer portions 70 and the bottom panel flaps progresses toward a right angle. This can be seen by comparing FIGS. 8, 10 and 12. The contact between the retaining flaps 54 and the locking tab portions 70 continually biases the locking tab portions during their movement through the secondary locking openings toward the edges formed by the slits 44. As a result, the locking tab portions contact and slide past the retaining tabs 48. When relative movement between the secondary locking tab portions 70 and the retaining tabs 48 brings the retaining cutouts 76 of the secondary locking tabs opposite the retaining tabs 48, the tabs 48 readily move into the retaining cutouts. Since the tabs 48 no longer contact the retaining flaps 54, these flaps are free to spring back to their original position. This final position is illustrated in both FIGS. 12 and 13. The retaining tabs 48 thus function as additional locking tabs to prevent the secondary locking tabs from being forced out of the secondary locking openings. At the same time, the retaining flaps 54 prevent the locking tab portions 70 from transversely moving, thereby maintaining the retaining tabs in the recesses 76.

It should now be clear that the invention permits the use of primary and secondary locks without requiring the secondary locking tabs to extend out beyond the adjacent edge of the carrier blank. It should also be clear that the unique design of the secondary lock protects against failure of the bottom panel by preventing accidental withdrawal of the secondary locking tab. Fabrication of the carrier is simple and does not require extra steps beyond those normally associated with the use of secondary locking tabs incorporating an intermediate fold line.

Although the carrier lock has been described in connection with a carrier for use with long necked bottles, it will be obvious that the invention could be employed in conjunction with carriers for wrapping short necked bottles, cans or other types of articles.

It will be apparent that the invention need not be limited to all the specific details described in connected with the preferred embodiment, but that changes to certain features of the preferred embodiment which do not alter the overall basic function and concept of the invention may be made without departing from the spirit and scope of the invention, as defined in the appended claims.

What is claimed is:

1. A wrap-around article carrier, comprising:

a top panel, opposite side panels and a bottom panel;

the bottom panel being comprised of inner and outer panel flaps, each panel flap having an end edge, a portion of the outer panel flap overlapping a portion of the inner panel flap;

the inner panel flap including a locking tab connected thereto by a fold line spaced from the end edge of the inner panel flap;

the locking tab including an intermediate fold line dividing the locking tab into a base portion and an end portion, the end portion of the locking tab containing a retaining opening adjacent the intermediate fold line; and the outer panel flap containing a locking opening spaced from the end edge of the outer panel flap, one edge of the locking opening being comprised of an edge of a retaining flap connected to the outer panel flap along a fold line located between the locking opening and the end edge of the outer panel flap and an opposite edge of the locking opening including a retaining tab extending from said opposite edge toward the end edge of the outer panel flap;

the base portion of the locking tab overlapping an end portion of the outer panel flap and the end portion of the locking tab extending through the locking opening in the outer panel flap;

the retaining tab extending through the retaining opening in the end portion of the locking tab and the edge of the retaining flap contacting the end portion of the locking tab.

2. The wrap-around carrier of claim 1, wherein the intermediate fold line in the locking tab is interrupted by the retaining opening.

3. The wrap-around carrier of claim 1, wherein the outer panel flap includes a transverse slit at each end of the locking opening, the transverse slits extending transversely of the end edge of the outer panel flap.

4. The wrap-around carrier of claim 1, wherein the end edge of the outer panel flap is adjacent to the fold line connecting the locking tab to the inner panel flap.

5. The wrap-around carrier of claim 1, wherein the locking tab and locking opening comprise a secondary lock, the outer panel flap including a primary locking tab engaging a primary locking edge in the inner panel flap.

6. The wrap-around carrier of claim 5, wherein the primary locking edge is an edge of a cutout corresponding in size and shape to the size and shape of the secondary locking tab.

7. In an article carrier, a panel comprising:

inner and outer panel flaps, each panel flap having an end edge, a portion of the outer panel flap overlapping a portion of the inner panel flap;

the inner panel flap including a locking tab connected thereto by a fold line spaced from the end edge of the inner panel flap;

the locking tab including an intermediate fold line dividing the locking tab into a base portion and an end portion, the end portion of the locking tab containing a retaining opening adjacent the intermediate fold line; and the outer panel flap containing a locking opening spaced from the end edge of the outer panel flap, one edge of the locking opening being comprised of an edge of a retaining flap connected to the outer panel flap along a fold line located between the locking opening and the end edge of the outer panel flap and an opposite edge of the locking opening including a retaining tab extending from said opposite edge toward the end edge of the outer panel flap;

the base portion of the locking tab overlapping an end portion of the outer panel flap and the end portion of the locking tab extending through the locking opening in the outer panel flap;

the retaining tab extending through the retaining opening in the end portion of the locking tab and the edge of the retaining flap contacting the end portion of the locking tab.

8. The carrier panel of claim 7, wherein the intermediate fold Line in the locking tab is interrupted by the retaining opening.

9. The carrier panel of claim 8, wherein the outer panel flap include B a transverse slit at each end of the locking opening, the transverse slits extending transversely of the end edge of the outer panel flap.

10. A blank for forming a wrap-around article carrier, comprising:

a generally rectangular sheet;

a centrally located top panel section connected by fold lines to opposite side panel sections, one of the side panel sections being connected by a fold line to an inner bottom panel flap and the other side panel section being connected by a fold line to an outer bottom panel flap;

each bottom panel flap having an end edge;

the inner bottom panel flap including a locking tab defined by a slit having ends connected to the inner bottom panel flap by a fold line spaced from the end edge of the inner bottom panel flap;

the locking tab including an intermediate fold line dividing the locking tab into a base portion and an end portion, the intermediate fold line being interrupted by a slit forming a retaining opening; and the outer panel flap containing a locking opening slit spaced from the end edge of the outer panel flap, one edge of the locking opening slit being comprised of an end edge of a retaining flap connected to the outer panel flap along a fold line located between the locking opening slit and the end edge of the outer panel flap and the opposite edge of the locking opening slit including a retaining tab extending from said opposite edge toward the end edge of the outer panel flap;

the base portion of the locking tab overlapping an end portion of the outer panel flap, the end portion of the locking tab extending through the locking opening slit in the outer panel flap, the retaining tab extending through the retaining opening in the end portion of the locking tab and the end edge of the retaining flap contacting the end portion of the locking tab in a carrier formed from the blank.

11. The wrap-around carrier blank of claim 10, wherein the outer panel flap includes a transverse slit at each end of the locking opening slit, the transverse slits extending transversely of the end edge of the outer panel flap.

12. The wrap-around carrier blank of claim 11, wherein the retaining flap has side edges formed from extensions of the transverse slits at the ends of the locking opening slit.

13. The wrap-around carrier of claim 10, wherein the locking tab and locking opening slit comprise a secondary lock, the outer panel flap including a primary locking tab and the inner panel flap including a slit forming a primary locking edge in a carrier formed from the blank.

14. The wrap-around carrier of claim 13, wherein the primary locking edge :slit is comprised of a portion of the slit forming the secondary locking tab.

* * * * *